US010890342B2

(12) United States Patent
Spain

(10) Patent No.: US 10,890,342 B2
(45) Date of Patent: Jan. 12, 2021

(54) FIRE VENTILATION SYSTEM

(71) Applicant: Wilson Spain, McKinney, TX (US)

(72) Inventor: Wilson Spain, McKinney, TX (US)

( * ) Notice: Subject to any disclaimer, the term of this patent is extended or adjusted under 35 U.S.C. 154(b) by 207 days.

(21) Appl. No.: 16/050,432

(22) Filed: Jul. 31, 2018

(65) Prior Publication Data

US 2019/0032936 A1 Jan. 31, 2019

Related U.S. Application Data

(60) Provisional application No. 62/538,937, filed on Jul. 31, 2017.

(51) Int. Cl.

| | |
|---|---|
| ***F24F 7/007*** | (2006.01) |
| ***F24F 13/08*** | (2006.01) |
| ***F24F 7/013*** | (2006.01) |
| ***F24F 13/02*** | (2006.01) |
| *A62C 3/02* | (2006.01) |

(52) U.S. Cl.
CPC ..... *F24F 7/013* (2013.01); *F24F 13/02* (2013.01); *A62C 3/0207* (2013.01)

(58) Field of Classification Search
CPC ..... F24F 7/013; F24F 13/02; A62C 3/0207
USPC ..... 454/354
See application file for complete search history.

(56) References Cited

U.S. PATENT DOCUMENTS

| | | | | |
|---|---|---|---|---|
| 4,433,985 | A | 2/1984 | McGee | |
| 4,886,233 | A | 12/1989 | Bateman et al. | |
| 5,370,576 | A * | 12/1994 | Krofchalk | B60H 1/00464 454/143 |
| 6,446,731 | B1 | 9/2002 | Sorosky | |
| 8,366,387 | B2 | 2/2013 | Reuter | |
| 8,678,889 | B2 | 3/2014 | Dean | |
| 2014/0255173 | A1 * | 9/2014 | Poulton | F04F 5/16 415/182.1 |

* cited by examiner

*Primary Examiner* — Helena Kosanovic
(74) *Attorney, Agent, or Firm* — Boudwin Intellectual Property; Daniel Boudwin

(57) ABSTRACT

A fire ventilation system. The fire ventilation system includes a frame having an open central area. The frame can removably secure within an opening of a building, such as a door or window. A flange extends away from the frame along an inner perimeter thereof. A tube having an inlet thereon, extends along an outer perimeter of the frame. A gap is disposed through the tube, wherein the gap can expel fluid received through the inlet therethrough, such that the gap expels the fluid towards the flange.

19 Claims, 4 Drawing Sheets

FIRE VENTILATION SYSTEM

CROSS REFERENCE TO RELATED APPLICATIONS

This application claims the benefit of U.S. Provisional Application No. 62/538,937 filed on Jul. 31, 2017. The above identified patent application is herein incorporated by reference in its entirety to provide continuity of disclosure.

BACKGROUND OF THE INVENTION

The present invention relates to a fire ventilation system. Specifically, the present invention relates to a fire ventilation system configured to secure on or within an opening of a building and generate negative pressure, thereby removing smoke, fire, and air therefrom.

When fighting fires within a building, firefighters often use various negative pressure methods to remove smoke, heat, and fire from the building to isolate and slow the spread of a fire, such that the damage to the building is minimized. Typical methods include smoke ejectors or fans within the building and directed to expel air from the building, however this often results to damage to the ejector or fan as fire passes therethrough. Furthermore, positioning the devices within a burning building can prove hazardous to a user. Additionally, many current methods fail to increase pressure sufficiently to generate a negative pressure environment to drive heat, smoke, and air from the building. Typical axial fans only increase pressure by up to 1%, whereas fires on average can increase the pressure within a building by up to 7%, leaving traditional fire ventilations systems insufficient to effectively ventilate a building. Therefore, a fire ventilation system capable of safely and efficiently generating a negative pressure environment to draw smoke, fire, and air from a building is desired.

In light of the devices disclosed in the known art, it is submitted that the present invention substantially diverges in design elements from the known art and consequently it is clear that there is a need in the art for an improvement to existing fire ventilation systems. In this regard, the instant invention substantially fulfills these needs.

SUMMARY OF THE INVENTION

In view of the foregoing disadvantages inherent in the known types of fire ventilation systems now present in the known art, the present invention provides a fire ventilation system wherein the same can be utilized for providing convenience for the user when attempting to remove smoke and oxygen from a burning building through an existing opening in the building.

The present system comprises a frame having an open central area, wherein the frame is configured to removably secure within an opening of a building. A flange extends perpendicularly away from an inner perimeter of the frame and a tube extends along an outer perimeter of the frame. An interior volume of the tube is in fluid communication with an inlet disposed therealong, such that fluid received through the inlet passes through the tube. A gap through the tube extends along the inner perimeter of the frame, wherein the gap is configured to expel fluid therefrom towards the flange, such that the fluid is guided in a desired direction to generate a pressure differential between opposing sides of the frame. In some embodiments, the gap extends along the inner perimeter parallel to the flange. In another embodiment a lip extends from the gap parallel to the flange, the lip configured to direct fluid towards the flange. In other embodiments, a distal end of the flange tapers outwardly relative to the central area at a desired angle. In yet another embodiment, the desired angle comprises 25 degrees to increase the pressure differential. In some embodiments, the fire ventilation system further comprises a pump in fluid communication with the inlet and a fluid source, wherein the pump is configured to deliver fluid through the inlet at a desired volumetric flowrate. In another embodiment, the pump further comprises a control thereon, the control configured to adjust the volumetric flowrate. In other embodiments, the frame comprises a plurality of interlocking sections. In yet another embodiment, the plurality of interlocking sections are configured to removably secure to each other such that the gap is aligned along adjacent sections. In some embodiments, each of the plurality of interlocking sections further comprise a hinge thereon, such that the plurality of interlocking sections is foldable about the hinge. In another embodiment, a fastener is disposed within each of the plurality of interlocking sections, the fastener configured to secure each interlocking section in a closed position. In other embodiments, an outer flange extends perpendicularly away from the outer perimeter of the frame. In yet another embodiment, a far end of the outer flange tapers inwardly relative to the central area at a desired angle. In some embodiments, the desired angle comprises 25 degrees to increase the pressure differential. In another embodiment, an outer gap is disposed through the tube along an outer perimeter of the frame, wherein the outer gap is configured to expel fluid from the tube towards the outer flange. In other embodiments, the outer gap further comprises an outer lip extending parallel to the outer flange, wherein the outer lip is configured to direct fluid expelled therefrom towards the flange. In yet another embodiment, the flange is configured to rest flush against the opening of the building when secured therein.

BRIEF DESCRIPTION OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
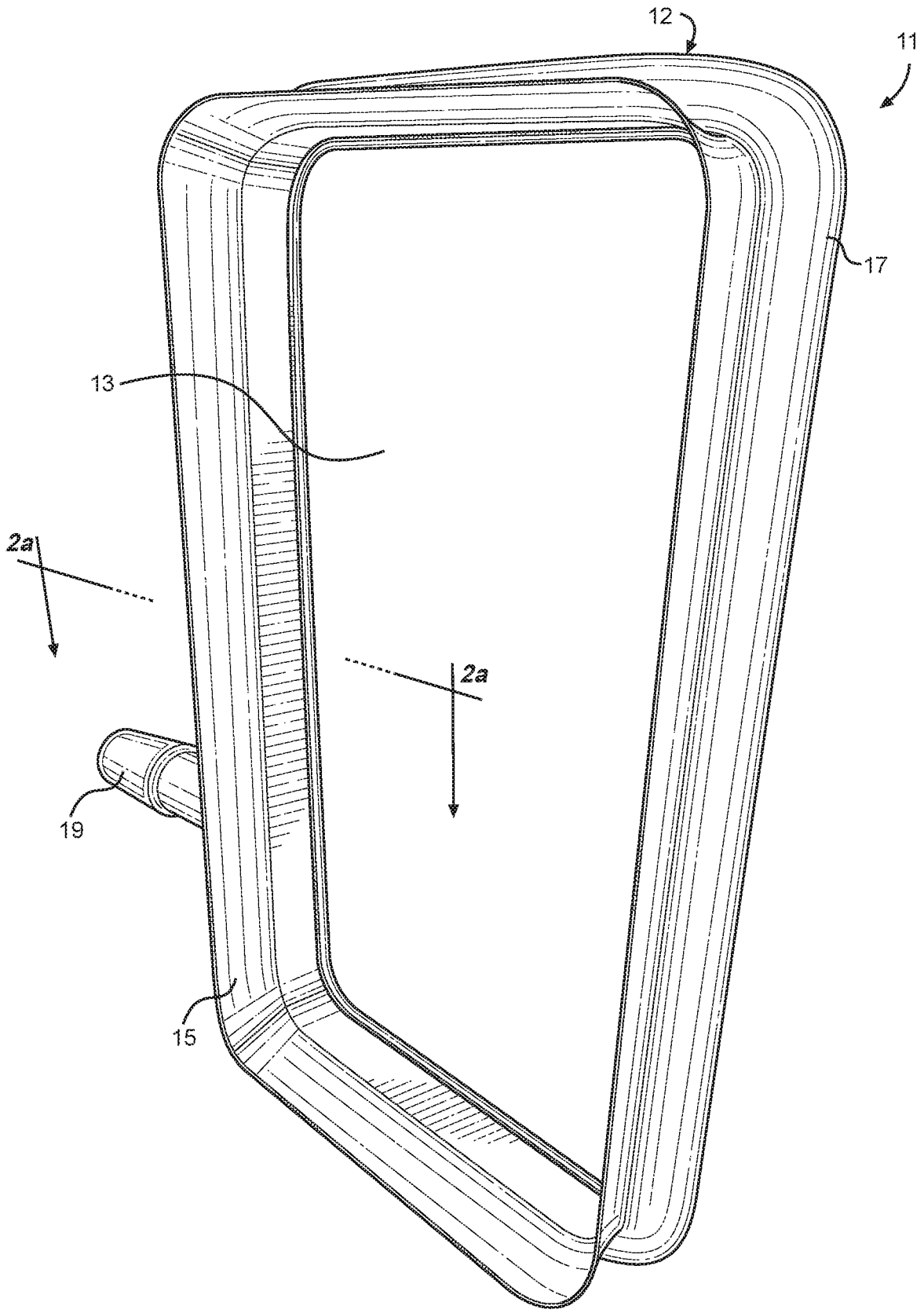
FIG. 1 shows a perspective view of an embodiment of the fire ventilation system.

Reference is made herein to the attached drawings. Like reference numerals are used throughout the drawings to depict like or similar elements of the fire ventilation system. The figures are intended for representative purposes only and should not be considered to be limiting in any respect.

Figure 2A:
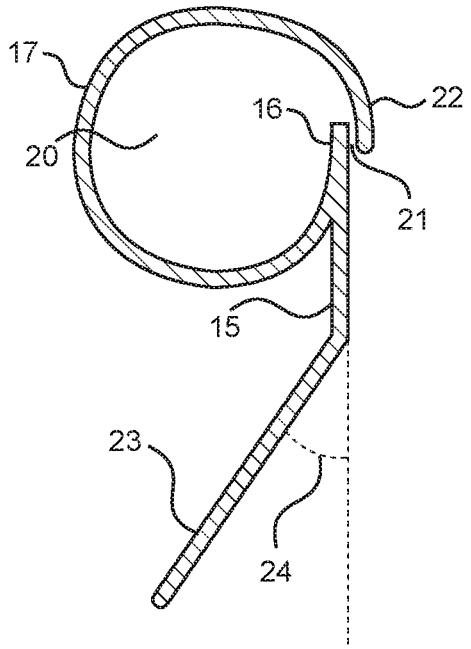
FIG. 2A shows a cross-sectional view of an embodiment of the fire ventilation system.

Referring now to FIG. 1, there is shown a perspective view of an embodiment of the fire ventilation system. The fire ventilation system 11 comprises a frame 12 having an open central area 13. A flange 15 extends perpendicularly away from the frame 12 along an inner perimeter (as shown in FIG. 2A, 16) thereof. The flange 15 allows a user to removably secure the frame 12 within an opening of a building, such as a door or a window. In some embodiments, the flange 15 is configured to rest flush against the opening when secured thereto, such that no air can pass between the flange 15 and the opening, thereby ensuring that all air or fluid moved through the frame 12 passes through the open central area 13. In this way, damage to the structure of the building caused by smoke, fire, heat, or the like is minimized. In some embodiments, the frame 12 is adjustable along a length and a width thereof, such as via telescopic motion, thereby allowing the frame 12 to secure within various sizes of openings.

Figure 2B:
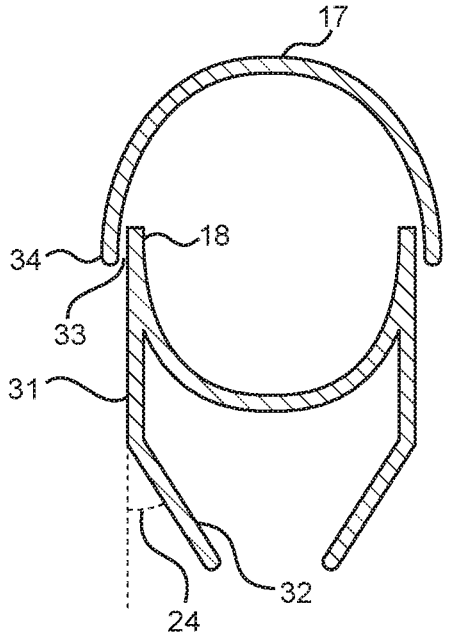
FIG. 2B shows a cross-sectional view of an alternate embodiment of the fire ventilation system.

A tube 17 surrounds the frame 12 along an outer perimeter (as shown in FIG. 2B, 18) thereof. The tube 17 is configured to receive fluid therein via an inlet 19 disposed therealong, which is then expelled through a gap (as shown in FIG. 2A, 2I) through the tube 17, towards the flange 15. The flange 15 is configured to guide the fluid expelled from the tube 17 in a rearward direction, thereby causing a pressure differential between opposing sides of the frame 12. In this way, air can be drawn through the open central area 13, thereby exiting the building, allowing a fire fighting unit to isolate, contain, or otherwise control a fire within the building.

Referring now to FIGS. 2A and 2B, there are shown cross-sectional views of various embodiments of the fire ventilation system. In the illustrated embodiment, the tube 17 further comprises an interior volume 20 in fluid communication with the inlet. Fluid is distributed through the tube 17 at a desired volumetric flowrate, such that the fluid can be expelled through a gap 21 disposed through the tube 17 at a constant and steady rate. The gap 21 extends along an inner perimeter 16 of the frame, such that fluid expelled therefrom is directed away from a building, thereby creating a pressure differential between opposing sides of the frame. In this way, smoke, heat, fire, and the like can be removed from a building through the frame via the generated pressure differential. In the illustrated embodiment, the gap 21 extends along the inner perimeter 16 parallel to the flange 15, such that the fluid passing through the gap 21 interacts with the flange 15, thereby ensuring that the fluid is guided along a desired trajectory to generate an increased pressure differential. In the illustrated embodiment, the gap 21 is defined by the inner perimeter 16 and a lip 22 extending beyond the plane of the inner perimeter 16. The lip 22 is configured to direct the fluid expelled from the gap 21 against the flange 15, such that the desired pressure differential is achieved.

The flange 15 extends perpendicularly away from the inner perimeter 16 of the frame. In some embodiments, the flange 15 proximal to the inner perimeter 16 is configured to rest flush against an opening of a building, such that a seal is formed thereabout, thereby ensuring that all smoke, fire, air, and the like removed from the building passes through the open central area. In the illustrated embodiment, the flange 15 comprises an angled portion disposed at a distal end 23 of the flange 15, wherein the angled portion tapers outwardly relative to the open central area at a desired angle 24. The angled portion is configured to increase the fluid flow out of a building, such that greater pressure differentials can be achieved. In this way, increased pressure generated by a fire can be overcome by including the angled distal end 23. In some embodiments, the desired angle 24 comprises 25-degrees in order to maximize fluid flow out of the building through the gap 21.

In the illustrated embodiment of FIG. 2B, the tube 17 further comprises an outer gap 33 disposed through the tube 17 along an outer perimeter 18 of the frame. In this way, fluid is expelled through both the outer gap 33 and the gap 21, thereby increasing the potential volume of fluid directed away from the building, such that a greater pressure differential can be achieved. An outer lip 34 extends beyond the plane of the outer perimeter 18, thereby ensuring that fluid expelled from the outer gap 33 interfaces with an outer flange 31. In the illustrated embodiment of FIG. 2B, the outer flange 31 further comprises an angled far end 32, wherein the far end 32 tapers inwardly relative to the open central area at a desired interior angle 24. In the illustrated embodiment, the desired interior angle 24 of the outer flange 31 and the flange 15 comprise the same angle, however alternate embodiments having different degrees of taper are contemplated. The tapering of the far end 32 of the outer flange 31 serves a similar function as that of the flange 15, wherein increased fluid flow against and past the outer flange 31 create greater pressure differentials, thereby allowing the fire ventilation device to remove greater volumes of smoke, flame, and the like from a burning building.

Figure 3:
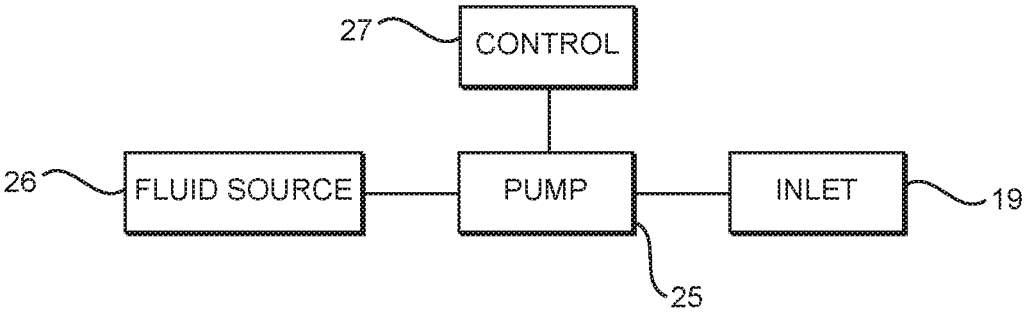
FIG. 3 shows a block diagram of the external components of an embodiment of the fire ventilation system.

Referring now to FIG. 3, there is shown a block diagram of the external components of an embodiment of the fire ventilation system. In the illustrated embodiment, the fire ventilation system further comprises a pump 25 in fluid communication with the inlet 19 and a fluid source 26. The fluid source 26 can comprise an air compressor, volume of water, fire hydrant, or the like, such that fluid can be delivered to the inlet 19 therefrom via the pump 25. Both air and water are contemplated as appropriate fluids for generating a pressure differential between opposing sides of the frame, each having strengths and weaknesses, such as power required to generate a desired volumetric flowrate, or the inherent cooling properties of large volumes of water to additionally combat the heat and fire within a burning building. In the illustrated embodiment, the pump 25 further comprises a control 27 thereon, the control 27 configured to adjust the volumetric flowrate of fluid delivered via the pump 25. In this way, the user can adjust the rate of fluid flow from the gap, and therefore, the pressure differential generated thereby, to allow for efficient ventilation of fires of various strength.

Figure 4:
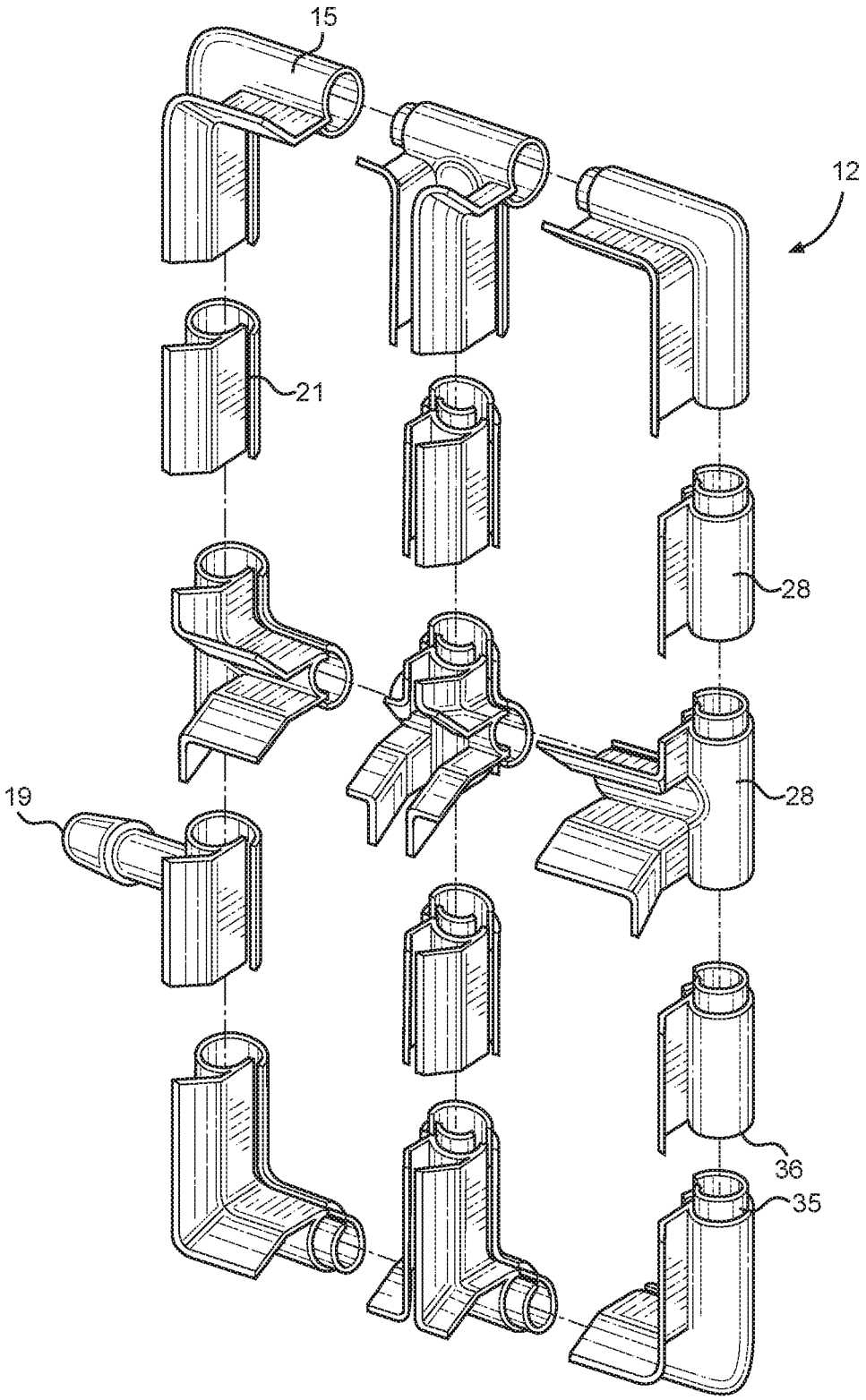
FIG. 4 shows an exploded view of an embodiment of the fire ventilation system.

Referring now to FIG. 4, there is shown an exploded view of an embodiment of the fire ventilation system. In the illustrated embodiment, the frame 12 further comprises a plurality of interlocking sections 28, wherein each of the plurality of interlocking sections 28 is configured to removably secure to each other, thereby allowing a user to adjust the size and dimensions of the frame 12 to fit the size of an opening in a building. The modular approach illustrated in FIG. 4 further provides greater portability to the fire ventilation system, allowing increased ease of transport to a scene of a fire. When secured together, the gap 21 is aligned along the inner perimeter of adjacent interlocking sections 28, such that fluid delivered from the inlet 19 is distributed through the assembled system. In the illustrated embodiment, the plurality of interlocking sections 28 fasten together via a protrusion 35 configured to removably secure within a recess 36 via friction fit.

In the illustrated embodiment, the plurality of interlocking sections 28 further comprise a central cross member configured to separate the open central area into a plurality of open areas, each bordered by a continuous gap 21 along an inner perimeter thereof. In this way, a greater volume of fluid can be expelled through the gap 21, thereby generating a greater pressure differential between opposing sides of the frame 12.

Figure 5A:
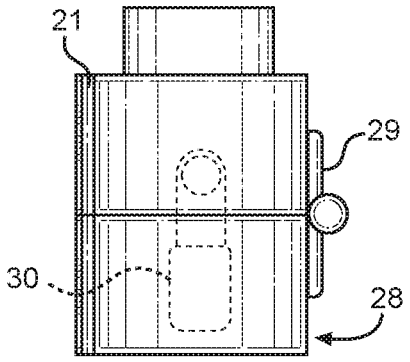
FIG. 5A shows a semi-transparent view of an embodiment of an interlocking section of the plurality of interlocking sections of the fire ventilation system in a closed position.
Figure 5B:
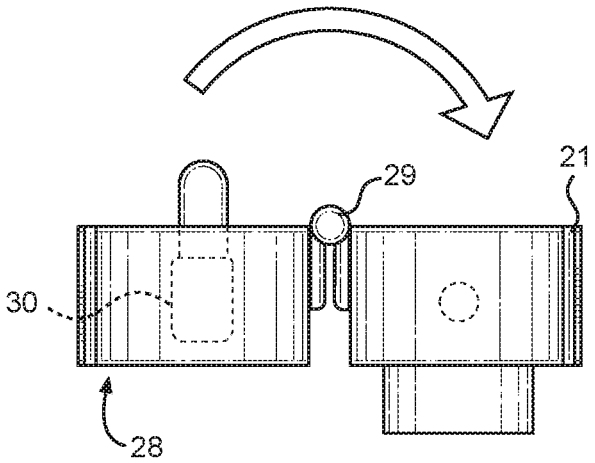
FIG. 5B shows a semi-transparent view of an embodiment of an interlocking section of the plurality of interlocking sections of the fire ventilation system in an open position.

Referring now to FIGS. 5A and 5B, there is shown a semi-transparent view of an embodiment of an interlocking section of the plurality of interlocking sections of the fire ventilation system in a closed position and a semi-transparent view of an embodiment of an interlocking section of the plurality of interlocking sections of the fire ventilation system in an open position, respectively. In the illustrated embodiment, each of the plurality of interlocking sections 28 comprises a hinge 29 thereon. The hinge 29 is configured to allow each interlocking section 28 to selectively move between an open position, as shown in FIG. 5B, and a closed position, as shown in FIG. 5A. The interlocking sections 28 are secured in the closed position via a fastener 30 disposed within each interlocking section 28. In the illustrated embodiment, the fastener 30 comprises a ball-detent system, however alternate fasteners, such as clips, latches, and the like are contemplated. When each interlocking section 28 is in the closed position, the gap 21 is aligned along an inner perimeter thereof, such that fluid can uniformly be expelled therethrough. The hinge 29 is configured to provide access to the interior volume of the frame, allowing the user to easily inspect, clean, or otherwise maintain each of the plurality of interlocking sections 28, as scaling can buildup therein due to impurities within the fluid delivered through the gap 21. In the shown embodiment, each interlocking section 28 includes mating friction-fit portions configured to semi-permanently connected with similar interlocking sections, thereby selectively forming a frame sized for an opening. In alternative embodiments, interlocking sections 28 are joined via alternative fasteners, such as latches and the like. The interlocking sections 28 are thus reconfigurable.

In one exemplary use, the user secures the frame within an opening of a burning building and activates the pump to deliver fluid through the tube and away from the building through the gap. In some embodiments, the frame can be adjusted in size, whether through telescopic motion or by assembling a modular system, to fit the desired opening. The user can then adjust the amount of fluid expelled away from the building via the control disposed on the pump, such that a negative pressure differential sufficient to overcome that generated by the fire is achieved, thereby allowing the user to ventilate the burning building efficiently. In this way, the fire can be managed, isolated, or otherwise controlled until the remaining firefighters can extinguish the fire.

It is therefore submitted that the instant invention has been shown and described in various embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A fire ventilation system, comprising:

a frame having an open central area;

wherein the frame is configured to removably secure to an opening;

a flange extending away from an inner perimeter of the frame;

the frame forming a tube extending along an outer perimeter of the frame;

an inlet disposed on the tube, the inlet in fluid communication with an interior volume of the tube;

a gap disposed through the tube along the inner perimeter of the frame, the gap configured to expel fluid therefrom;

a central column for separating the open central area, said central column extending between an upper portion of the frame and a lower portion of the frame, wherein the central column is in fluid communication with the tube;

wherein the gap is configured to expel fluid towards the flange, such that the fluid is guided along the flange to crease a pressure differential between opposing sides of the frame.

2. The fire ventilation system of claim 1, wherein the gap extends along the inner perimeter parallel to the flange.

3. The fire ventilation system of claim 1, wherein a lip extends from the tube parallel to the flange, the lip configured to direct fluid towards the flange.

4. The fire ventilation system of claim 1, wherein a distal end of the flange extends outwardly relative to the central area at a desired angle.

5. The fire ventilation system of claim 4, wherein the desired angle comprises 25 degrees.

6. The fire ventilation system of claim 1, further comprising an external pump in fluid communication with the inlet and a fluid source, wherein the external pump is configured to deliver fluid through the inlet.

7. The fire ventilation system of claim 6, wherein the pump further comprises a control thereon, the control configured to adjust a volumetric flowrate.

8. The fire ventilation system of claim 1, wherein the frame comprises a plurality of interlocking sections, wherein the plurality of interlocking sections each comprise a continuous length of the tube.

9. The fire ventilation system of claim 8, wherein the plurality of interlocking sections are configured to removably secure to each other such that the gap is continuous along adjacent sections.

10. The fire ventilation system of claim 8, wherein each of the plurality of interlocking sections further comprises a hinge thereon dividing each of the plurality of interlocking sections into an upper portion and a lower portion, wherein the upper and lower portions each comprise a continuous length of the tube, such that the plurality of interlocking sections is foldable about the hinge.

11. The fire ventilation system of claim 10, further comprising a fastener within each of the plurality of interlocking sections, the fastener configured to secure each interlocking section in a closed position.

12. The fire ventilation system of claim 1, wherein a far end of the outer flange extends inwardly relative to the central area at a desired interior angle.

13. The fire ventilation system of claim 12, wherein the desired interior angle comprises 25 degrees.

14. The fire ventilation system of claim 1, further comprising an outer gap through the tube along the outer perimeter of the frame, the outer gap configured to expel fluid from the tube towards the outer flange.

15. The fire ventilation system of claim 14, wherein the outer gap further comprises an outer lip extending parallel to the outer flange, the outer lip configured to direct fluid expelled therefrom towards the outer flange.

16. The fire ventilation system of claim 1, wherein the flange extends perpendicularly away from the frame.

17. The fire ventilation system of claim 1, wherein the gap is continuous along an entirety of the frame.

18. The fire ventilation system of claim 1, wherein the tube comprises a single sidewall having a free end, wherein the free end and the inner perimeter define a gap, and wherein the gap faces a rear side of the frame.

19. The fire ventilation system of claim 1, wherein the flange comprises a linear segment extending from the frame and an angled segment extending from a distal end of the linear segment at a desired angle.

* * * * *